United States Patent [19]

Bresson et al.

[11] Patent Number: 4,681,675

[45] Date of Patent: Jul. 21, 1987

[54] ORE FLOTATION

[75] Inventors: Clarence R. Bresson; Robert M. Parlman, both of Bartlesville, Okla.

[73] Assignee: Phillips Petroleum Company, Bartlesville, Okla.

[21] Appl. No.: 854,732

[22] Filed: Apr. 18, 1986

Related U.S. Application Data

[63] Continuation of Ser. No. 722,627, Apr. 12, 1985, abandoned.

[51] Int. Cl.[4] ..... B03D 1/02

[52] U.S. Cl. ..... 209/167; 252/61

[58] Field of Search ..... 209/166, 167; 252/61

[56] References Cited

U.S. PATENT DOCUMENTS

| | | | |
|---|---|---|---|
| 2,125,337 | 8/1938 | Gaudin | 209/166 |
| 4,231,859 | 11/1980 | Hulatt et al. | 209/11 |
| 4,400,312 | 8/1983 | Lindstrom et al. | 252/545 |
| 4,416,770 | 11/1983 | Bresson et al. | 209/167 |

FOREIGN PATENT DOCUMENTS

| | | | |
|---|---|---|---|
| 534983 | 3/1941 | United Kingdom | 209/166 |

*Primary Examiner*—Bernard Nozick

*Attorney, Agent, or Firm*—French & Doescher

[57] ABSTRACT

3-Hydroxytrimethylene sulfides are useful in ore flotation processes as depressants for iron, nickel, lead and/or zinc.

15 Claims, No Drawings

ORE FLOTATION

This application is a continuation of application Ser. No. 722,627, now abandoned, filed 4/12/85.

This invention relates to mineral recovery by ore flotation processes.

Froth flotation is a process for recovering and concentrating minerals from ores. In a froth flotation process the ore is crushed and wet ground to obtain a pulp. Additives such as mineral flotation or collecting agents, frothing agents, depressants, stabilizers, etc. are added to the pulp to assist in separating valuable minerals from the undesired or gangue portions of the ore in subsequent flotation steps. The pulp is then aerated to produce a froth at the surface. The minerals which adhere to the bubbles or froth are skimmed or otherwise removed and separated. Selective depressants inhibit the adherence of certain minerals to the bubbles or froth thus assisting in the separation of the froth product from the reject product which includes those minerals depressed by the depressant agent. The froth products or the reject product or both can then be further processed to obtain the desired minerals, such as by additional flotation stages. Generally the ore is initially floated to produce a rougher concentrate, the rougher concentrate thereafter being refloated in the presence of depressants to further separate the minerals therein. Typical mineral flotation collectors include xanthates, amines, alkyl sulfates, arenes, sulfonates dithiocarbamates, dithiophosphates, fuel oils and thiols.

It is a continuing goal in the ore-processing industry to increase the productivity of ore flotation processes and, above all, to provide specific procedures which are selective to one ore or mineral over other ores or minerals present in the treated material.

OBJECTS OF THE INVENTION

An object of the invention, therefore, is a selective ore flotation process.

This and other objects will become apparent from further study of the disclosure and claims herein provided.

STATEMENT OF THE INVENTION

In accordance with the present invention we have discovered that 3-hydroxytrimethylene sulfide and lower alkyl derivatives thereof are selective depressants when employed in ore flotation processes.

DETAILED DESCRIPTION OF THE INVENTION

In accordance with the present invention, process for the recovery of minerals from particulate solids containing minerals is provided which comprises first mixing the solids with water, a collector, and a 3-hydroxytrimethylene sulfide to establish a pulp, then aerating the pulp to produce a froth containing a first portion of minerals while allowing a second portion of minerals to be depressed in the pulp and finally recovering the first portion of minerals from the froth and, optionally, recovering the depressed minerals from the pulp.

In accordance with a particular embodiment of the present invention, process is provided for recovery of minerals from a rougher concentrate by mixing said rougher concentrate with water and a 3-hydroxytrimethylene sulfide to establish a pulp, then aerating the pulp to produce a pulp containing a first portion of minerals while allowing a second portion of minerals to be depressed in the pulp, and finally recovering the first portion of minerals from the froth and, optionally recovering depressed minerals from the pulp.

The 3-hydroxymethylene sulfide depressants contemplated to be useful in the practice of the present invention are those having the formula:

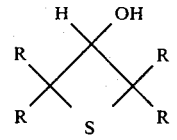

wherein each R is independently hydrogen or a $C_1$–$C_3$ alkyl radical. Specific examples of 3-hydroxytrimethylene sulfide depressants include 3-hydroxymethylene sulfide, 2-methyl-3-hydroxytrimethylene sulfide, 2,2-dimethyl-3-hydroxymethylene sulfide, 2,4-dimethyl-3-hydroxymethylene sulfide, and the like.

The ore flotation process of the present invention involves subjecting a mineral containing solid to a grinding operation preparatory to mixing the ground material with water to obtain a pulp. One or more flotation agents are incorporated in the pulp and the pulp is then aerated to produce a froth at the surface which is rich in valuable ore materials but depleted of the gangue materials or vice versa. The ore materials, optionally, after additional flotation ore frothing steps in which the depressant of the present invention can be employed, are recovered. In addition to the depressant of the present invention, frothing agents, other selective depressants, collectors, promoters and stabilizers which are known in the art can be used in the various flotation steps. Generally, the depressant of the present invention will be advantageously employed in the flotation of a rougher concentrate following the use of a collector in a prior flotation step wherein molybdenum, copper, iron, and the like are separated as the rougher concentrate from the gangue materials in the ore.

The amount of 3-hydroxytrimethylene sulfide depressant employed in the mineral recovery process of the present invention is not critical. The quantity employed will depend upon numerous variables, including the particular ore being treated, the concentration of the desired minerals in the ore being treated and the process parameters of the flotation process employed. Generally, the depressant compounds of the present invention will be employed in the ore flotation mineral recovery process at a concentration levels sufficient to provide the desired depressant action on certain minerals. The amount of 3-hydroxytrimethylene sulfide employed as a depressant in the mineral recovery process of the present invention will generally range from about 0.005 pounds to about 10 pounds per ton of solids or crushed ore. More preferably, the amount of 3-hydroxytrimethylene sulfide employed will range from about 0.1 to 6 pounds per ton of solids, e.g., concentrates. The depressants employed in the practice of the present invention can be added to an ore flotation mineral recovery process or system at the ore-grinding stage, the ore flotation step and/or to the concentrate which is to be further floated.

The 3-hydroxytrimethylene sulfide compounds disclosed herein are useful for separating any valuable metal sulfide from its corresponding gangue material. It is also understood by those of skill in the art that the 3-hydroxytrimethylene sulfide compounds can facilitate the separation of a mixture of minerals that are contained in a particular mining deposit or ore, said mixture being further separated by subsequent froth flotations or any other conventional separating methods. The 3-hydroxytrimethylene sulfide compounds disclosed herein are particularly useful as iron, nickel, lead and/or zinc depressants in the separation of such minerals as molybdenum from the total ore. Examples of such molybdenum-bearing ores include, but are not limited to such materials as Molybdenum-bearing ores:
Molybdenite: $MoS_2$
Wulfenite: $PbMoO_4$
Powellite: $Ca(Mo,W)O_4$
Ferrimolybdite: $Fe_2Mo_3O_{12}8H_2O$ Other metal bearing ores within the scope of this invention are, for example, but are not limited to, such materials as Copper-bearing ores:
Covellite: $CuS$
Chalcocite: $Cu_2S$
Chalcopyrite: $CuFeS_2$
Bornite: $Cu_5FeS_4$
Cubanite: $Cu_2SFe_4S_5$
Valerite: $Cu_2Fe_4S_7$ or $Cu_3Fe_4S_7$
Enargite: $Cu_3(As,Sb)S_4$
Tetrahedrite: $Cu_3SbS_2$
Tennanite: $Cu_{12}As_4S_{13}$
Cuprite: $Cu_2O$
Tenorite: $CuO$
Malachite: $Cu_2(OH)_2CO_3$
Azurite: $Cu_3(OH)_2CO_3$
Antlerite: $Cu_3SO_4(OH)_4$
Brochantite: $Cu_4(OH)_6SO_4$
Atacamite: $Cu_2Cl(OH)_3$
Chrysocolla: $CuSiO_3$
Famatinite: $Cu_3(Sb,As)S_4$
Bournonite: $PbCuSbS_3$
Lead-bearing ore:
Galena: $PbS$
Antimony-bearing ore:
Stibnite: $Sb_2S_3$
Zinc-bearing ores:
Sphalerite: $ZnS$
Zincite: $ZnO$
Smithsonite: $ZnCo_3$
Iron-bearing ores:
Pyrite or Marcasite: $FeS_2$
Pyrrhotite: $Fe_5S_6$ to $Fe_{16}S_{17}$
Daubreelite: $FeSCrS_3$
Nickel-bearing ores:
Pentlandite: $(FeNi)S$
Millerite: $NiS$
Niccolite: $NiAs$ The presently preferred ores in connection with which the process of this invention is applied are molybdenum, lead, copper and iron ores or minerals.

SEPARATION CONDITIONS

Any froth flotation apparatus can be used in the practice of this invention. The most commonly used commercial flotation machines are the Agitar (Galigher Co.), Denver Sub-A (Denver Equipment Co.), and the Fagergren (Western Machinery Co.). Smaller laboratory scale apparatus such as the Hallimond cell can also be used.

The instant invention was demonstrated in tests conducted at ambient room temperature to about 37° C. (100° F.) and atmospheric pressure. However, any temperature or pressure generally employed by those skilled in the art is within the scope of this invention.

EXAMPLE

This example describes the procedure used to evaluate 3-hydroxytrimethylene sulfide in an ore flotation process and demonstrates its usefulness as a mineral depressant. About 750 grams of a CU/Ni/Fe-containing ore (Falconbridge) along with 300 milliliters of tap water and 0.5 grams (1.3 lb/ton) of lime was added to a ball mill and ground for 2 minutes and 52 seconds. The ground mixture was transferred to a 2.5 Liter capacity Denver D-12 flotation cell along with enough water to make about a 30 weight percent aqueous slurry. Also added was 6 drops (0.068 lb/ton) of frother (Dowfroth 250) and 6 milliliters (0.16 lb/ton) of a 1 weight percent aqueous solution of sodium isopropyl xanthate (from American Hoescht) and the slurry conditioned for 1 minute. After conditioning, the slurry was floated for 7 minutes and the concentrate filtered, dried and analyzed. The procedure was repeated and the average weight percent recovery calculated. In this manner there was obtained average weight recoveries of 89.2 percent Cu, 78.6 percent Ni, and 57.1 weight percent Fe.

The procedure was again repeated except that in addition to the frother and xanthate collector there was also added 0.8 milliliters (2 lbs/ton) of 3-hydroxytrimethylene sulfide. After the sulfide addition, the slurry was conditioned for 2 minutes, then floated for 7 minutes. The concentrate was filtered, dried and analyzed to determine whether the sulfide acted as a depressant, collector, or had no affect at all. The run was repeated to obtain average recovery values. The results are listed in Table I.

TABLE I

3-Hydroxytrimethylene Sulfide as a Ni and Fe Suppressant in Ore Flotation

| | Reagent, lb/ton | | Wt. % Recovery | | | % Fe |
|---|---|---|---|---|---|---|
| Run | NaIPX[a] | HTMS[b] | Cu | Ni | Fe | Decrease |
| Control: | | | | | | |
| 1 | 0.16 | — | 90.86 | 80.77 | 58.52 | |
| 2 | 0.16 | — | 87.56 | 76.48 | 55.64 | |
| | | Average = | 89.21 | 78.62 | 57.08 | — |
| Invention: | | | | | | |
| 3 | 0.16 | 2.0 | 89.19 | 64.77 | 36.27 | |
| 4 | 0.16 | 2.0 | 85.11 | 65.10 | 36.41 | |
| | | Average = | 87.15 | 64.93 | 36.34 | 36.4 |

[a]1 Wt. % aqueous sodium isopropyl xanthate.
[b]3-hydroxytrimethylene sulfide.

The results show that 3-hydroxytrimethylene sulfide acted as a depressant by reducing the amount of Ni and Fe floated. Since the percent recovery of Cu is about the same as when only xanthate was used, these results demonstrate the use of 3-hydroxytrimethylene sulfide to upgrade Cu-containing ores.

The examples have been provided merely to illustrate the practice of our invention and should not be read so as to limit the scope of our invention or the appended claims in any way. Reasonable variations and modifications, not departing from the essence and spirit of our invention, are contemplated to be within the scope of patent protection desired and sought.

We claim:

1. A process for recovering metal values selected from the group consisting of:
   molybdenum and
   copper,
from particulate solids containing said metal values in the presence of at least one sulfide selected from the group consisting of:
   iron,
   nickel,
   lead, and
   zinc,
which process comprises:
   (a) mixing said solids with water, a collector and a 3-hydroxytrimethylene sulfide of the formula:

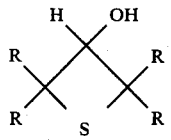

wherein each R is independently H or $C_1$–$C_3$ alkyl radical, to establish a pulp;
   (b) aerating said pulp to produce a froth containing a first portion of said minerals while allowing a second portion of said minerals to be depressed in said pulp; and
   (c) recovering said first portion of said minerals from said froth.

2. A process in accordance with claim 1 wherein said solids comprise crushed ore.

3. A process in accordance with claim 1 wherein said collector is present in the range of about 0.001–1.0 pounds per ton of said solids and said 3-hydroxytrimethylene sulfide is present in the range of about 0.005–10 pounds per ton of said solids.

4. A process in accordance with claim 1 wherein said collector is a xanthate collector.

5. A process in accordance with claim 4 wherein said xanthate collector is sodium isopropyl xanthate.

6. A process in accordance with claim 1 wherein said 3-hydroxytrimethylene sulfide is 3-hydroxytrimethylene sulfide.

7. A process in accordance with claim 1 wherein said solids comprise at least the metal values of
   copper and
   iron.

8. A process in accordance with claim 7 wherein said solids comprise a Cu/Ni/Fe-containing ore.

9. A process for recovering metal values selected from the group consisting of:
   molybdenum and
   copper,
from a rougher concentrate containing said metal values in the presence of at least one sulfide selected from the group consisting of sulfides of:
   iron,
   nickel,
   lead, and
   zinc,
which process comprises:
   (a) mixing a rougher concentrate containing said minerals with water, a collector and a 3-hydroxytrimethylene sulfide of the formula:

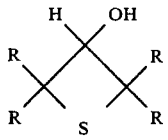

wherein each R is independently H or $C_1$–$C_3$ alkyl radical, to establish a pulp;
   (b) aerating said pulp to produce a froth containing a first portion of said minerals while allowing a second portion of said minerals to be depressed in said pulp; and
   (c) recovering said first portion of said minerals from said froth and recovering said depressed minerals from said pulp.

10. A process in accordance with claim 9 wherein said 3-hydroxytrimethylene sulfide is 3-hydroxytrimethylene sulfide.

11. A process in accordance with claim 9 wherein said collector is present in the range of abut 0.001–10 pounds per ton of said solids and said 3-hydroxytrimethylene sulfide is present in the range of about 0.005–10 pounds per ton of said solids.

12. A process in accordance with claim 9 wherein the collector is a sodium isopropyl xanthate collector.

13. A process in accordance with claim 12 wherein said xanthate collector is sodium isopropyl xanthate.

14. A process in accordance with claim 9 wherein said rougher concentrate comprises at least the metal values of:
   copper, and
   iron.

15. A process in accordance with claim 14 wherein said rougher concentrate comprises a Cu/Ni/Fe-containing ore.

* * * * *